US005842655A

United States Patent [19]

McCarthy

[11] Patent Number: 5,842,655

[45] Date of Patent: Dec. 1, 1998

[54] DEVICE FOR DISPENSING YARN AND LIKE MATERIAL

[76] Inventor: Vivian McCarthy, 1376 Abbey Way, Bensalem, Pa. 19020

[21] Appl. No.: 884,194

[22] Filed: Jun. 30, 1997

[51] Int. Cl.[6] ..... B02C 9/04

[52] U.S. Cl. ..... 242/129; 242/128; 242/140; 242/157 R; 242/597.6; 242/597.7

[58] Field of Search ..... 242/597.6, 597.7, 242/128, 129, 140, 157 R

[56] References Cited

U.S. PATENT DOCUMENTS

| | | | |
|---|---|---|---|
| 463,822 | 11/1891 | Bates | 242/140 |
| 2,621,868 | 12/1952 | Clark et al. | 242/597.7 |
| 2,887,281 | 5/1959 | Caufield | 242/597.7 |
| 3,575,358 | 4/1971 | Manner | 242/129 |
| 3,937,414 | 2/1976 | Bank et al. | 242/129 |
| 4,953,810 | 9/1990 | Stadig | 242/597.7 |
| 5,651,510 | 7/1997 | Eble et al. | 242/129 |

FOREIGN PATENT DOCUMENTS

| | | | |
|---|---|---|---|
| 793003 | 4/1958 | United Kingdom | 242/128 |

*Primary Examiner*—William Stryjewski
*Attorney, Agent, or Firm*—Armand M. Vozzo, Jr.

[57] ABSTRACT

An improved yarn and thread dispenser is disclosed for supplying threaded material in different wound configurations to a user in the process of knitting or crocheting. The present dispenser comprises a base member intended to rest on a level surface near to the user and a circular support plate rotatably connected to the top of the base member by means of a ball-bearing coupling. A cone-shaped member having a coarse outer surface is centrally stationed in a vertical position upon the support plate with an elongated rod coaxially extending therethrough so that the cone-shaped member and rod rotate together with the support plate. The cone-shaped member is specially adapted to engage a variety of wound spools of yarn or like threaded material and holds the spools securely upon its coarse surface while rotating. With the cone-shaped member removed, the elongated rod is adapted to remain stationed centrally to the support plate and serves to mount various skeins of yarn and the like for rotation upon the support plate. A guide rod with elongated loop is vertically mounted to the base member alongside the support plate to route the yarn material from the spool or skein as it rotates in place upon the support plate under the drawing force of the user.

9 Claims, 4 Drawing Sheets

DEVICE FOR DISPENSING YARN AND LIKE MATERIAL

BACKGROUND OF THE INVENTION

The present invention relates to holders adapted to dispense yarn or like stranded material to a user in the process of knitting or crocheting, and more particularly, to an improved yarn and thread dispenser that is adapted to engage a variety of wound configurations of stranded material and rotatably support each configuration in such manner that the material is dispensed to the user as needed.

Individuals who knit or crochet generally sit in a relatively comfortable and stationary position while they work, gradually drawing the yarn or other stranded material to them as they proceed between stitches. The yarn material, typically wound in a skein or spool, is usually placed on the floor or other substantially level surface near to the user and drawn in a random fashion as the user may require additional material. A spool of yarn or thread often unravels unnecessarily and with little or no control when drawn in this fashion, while a skein of stranded material tends to slip or slide along the surface where it is placed and not feed the desired amount of material to the user without constant pulling on or repositioning of the skein. In any case, this random and uncontrolled drawing of the wound material, either from a spool or skein, causes increased chances for tangling of the material that interrupt the knitting process and disrupt the knitter.

Numerous holders for skeins and spools of wound thread material have been devised for use in supplying needed material to knitters and crocheters while attending to their work. While the prior holders have served adequately to feed a supply of threaded material from a particular type of skein or spool for which the holder was designed, such holders have not effectively worked with the variety of sizes and configurations of stranded material as wound on the assortment of skeins and spools currently available. A need therefore exists for an improved device which can effectively dispense yarn and similar thread material from any of the current variety of wound configurations and thereby supply the needed material to the knitter or crocheter in a relatively smooth and untangled manner regardless of the size or shape of the skein or spool.

SUMMARY OF THE INVENTION

Accordingly, it is a general purpose and object of the present invention to provide an improved device for dispensing yarn and other similar stranded material wound in a variety of different configurations.

A more particular object of the present invention is to provide a yarn and thread dispenser for use by a knitter or crocheter that effectively unwinds any of an assortment of skeins and spools of wound material and supplies needed material when drawn by the user, in a smooth and untangled manner.

Another object of the present invention is to provide an adjustable yarn and thread dispenser that may be adapted for use in knitting or crocheting with a variety of commercially available skeins and spools of wound material.

Still another object of the present invention is to provide an effective yarn and thread dispensing device that is convenient to use and easily maintained by the knitter or crocheter.

A still further object of the present invention is to provide a yarn and thread dispenser that is relatively simple to implement and reasonably inexpensive to manufacture.

Briefly, these and other objects of the present invention are accomplished by an improved yarn and thread dispenser for supplying threaded material in different wound configurations to a user in the process of knitting or crocheting. The present dispenser comprises a base member intended to rest on a level surface near to the user and a circular support plate rotatably connected to the top of the base member by means of a ball-bearing coupling. A cone-shaped member having a coarse outer surface is centrally stationed in a vertical position upon the support plate with an elongated rod coaxially extending therethrough so that the cone-shaped member and rod rotate together with the support plate. The cone-shaped member is specially adapted to engage a variety of wound spools of yarn or like threaded material and holds the spool securely upon its coarse surface while rotating. With the cone-shaped member removed, the elongated rod is adapted to remain stationed centrally to the support plate and serves to hold a skein or like wound supply of yarn for rotation upon the support plate. A guide rod with elongated loop is vertically mounted to the base member alongside the support plate to route the yarn material from the spool or skein as it rotates in place upon the support plate under the drawing force of the user.

For a better understanding of these and other aspects of the present invention, reference may be made to the following detailed description taken in conjunction with the accompanying drawings in which like reference numerals and characters designate like parts throughout the figures thereof.

BRIEF DESCRIPTION OF THE DRAWINGS

For a fuller understanding of the nature and objects of the present invention, reference shall be made in the following detailed description to the accompanying drawings in which.

DESCRIPTION OF THE PREFERRED EMBODIMENT

Figure 1:
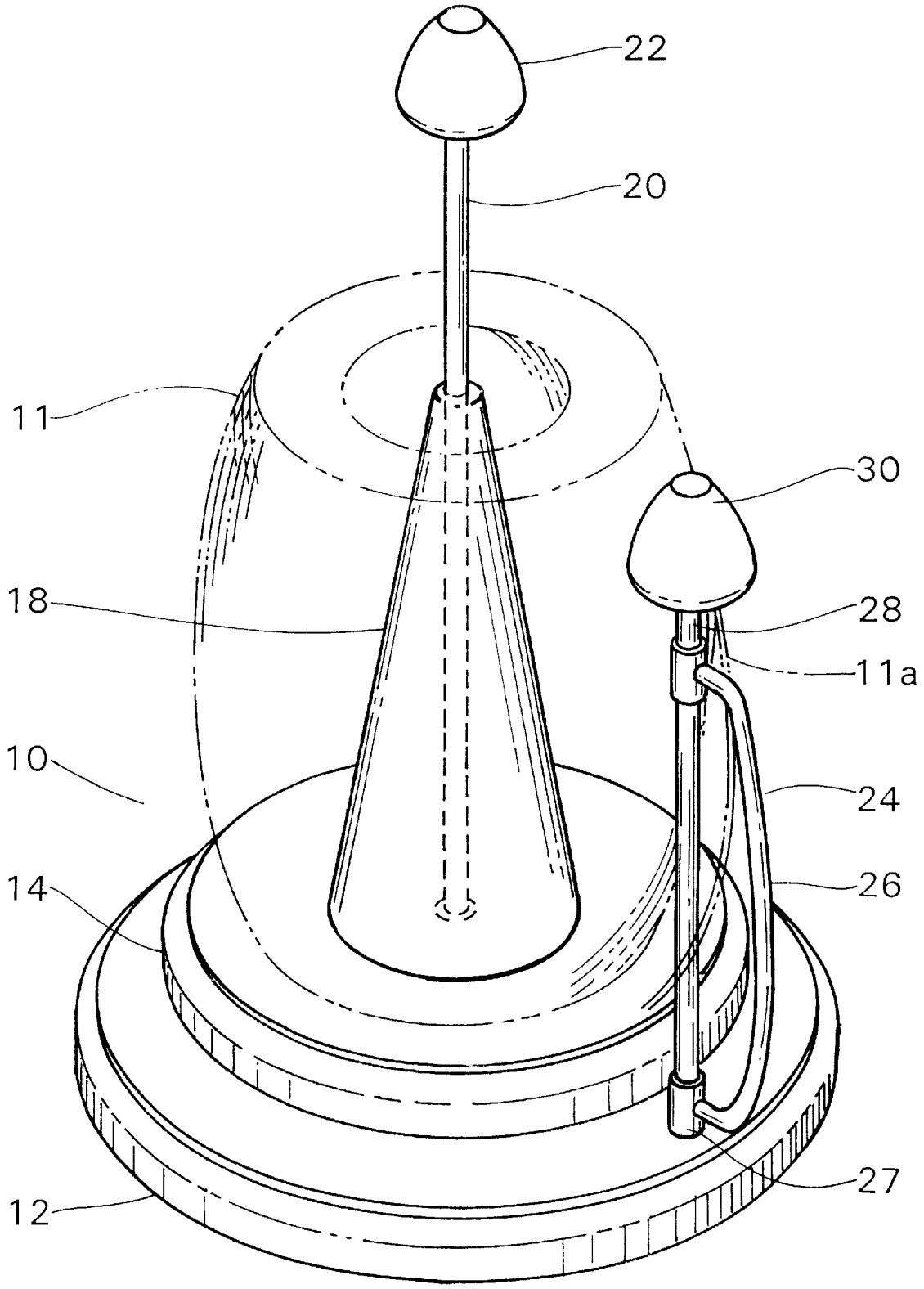
FIG. 1 is a top perspective view of a preferred embodiment of a yarn and thread dispenser according to the present invention shown engaged with a yarn spool (outlined in phantom) for dispensing operation.

Referring now to the drawings and particularly at first to FIG. 1, a preferred embodiment of a yarn and thread dispenser, generally designated 10, is shown intended for use in supplying yarn or like threaded material 11*a* from a wound spool 11 (depicted in phantom outline) to a knitter or crocheter (not shown) in proximity to the dispenser. In accordance with its operation described in greater detail hereinbelow, the dispenser 10 is intended to stand in place and function on a substantially horizontal platform, such as a floor or table, positioned near to the knitter or crocheter so that the yarn material 11*a* can be directly drawn from the dispenser.

Figure 2:
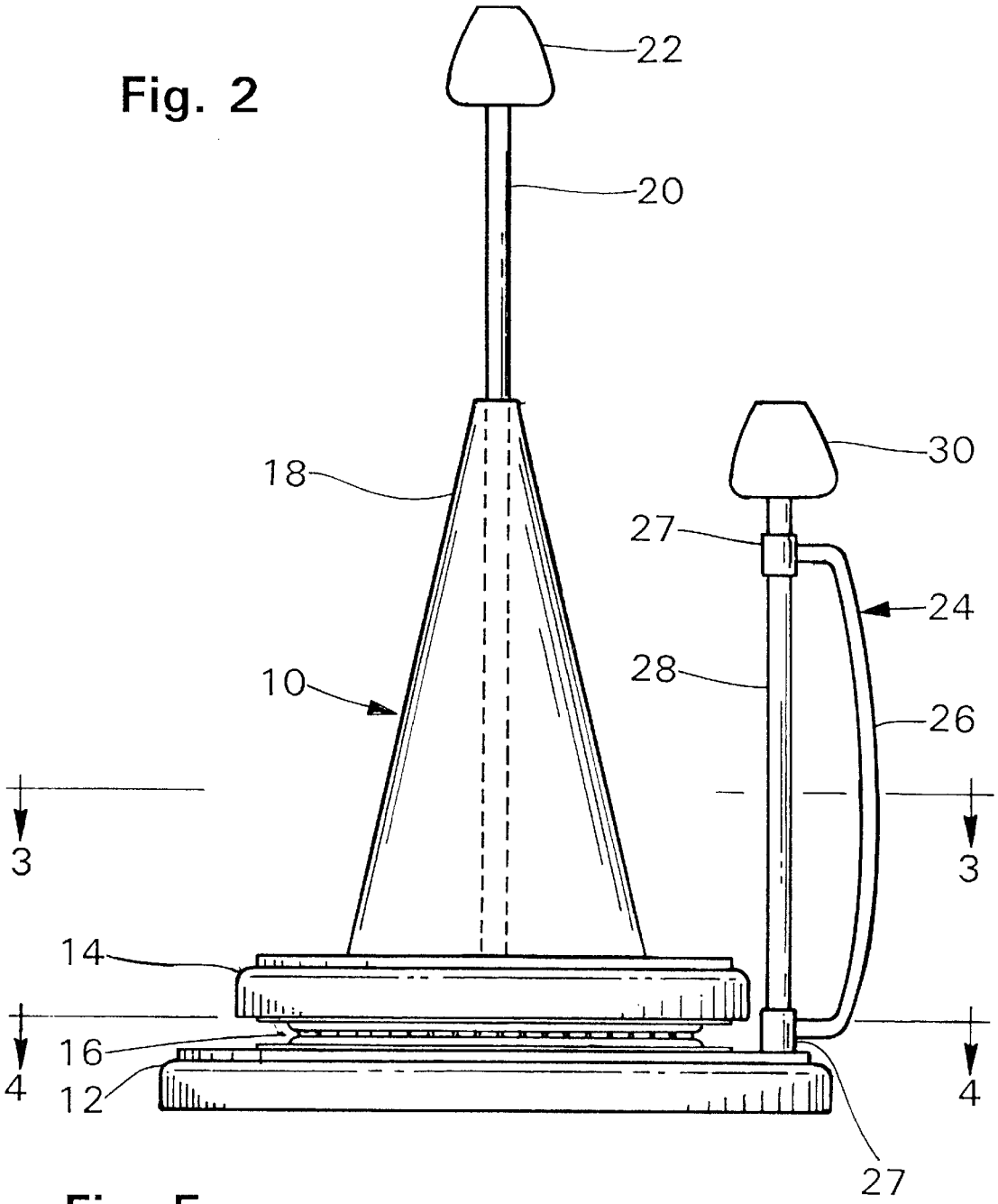
FIG. 2 is a side elevation view of the yarn and thread dispenser of FIG. 1 with the yarn spool removed therefrom.
Figure 5:
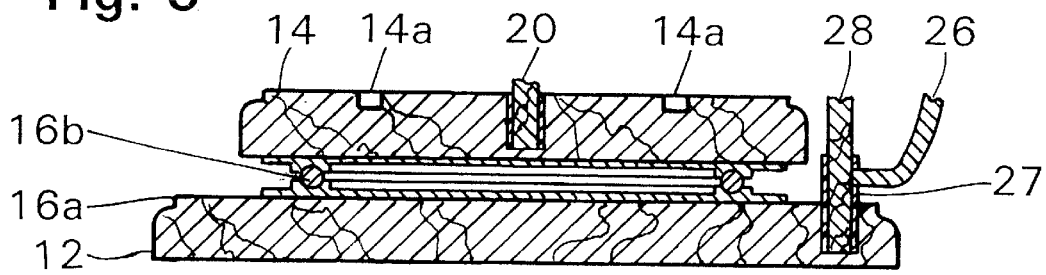
FIG. 5 is a sectional view of the yarn and thread dispenser of FIG. 2 taken along the line 5—5 in FIG. 3.
Figure 3:
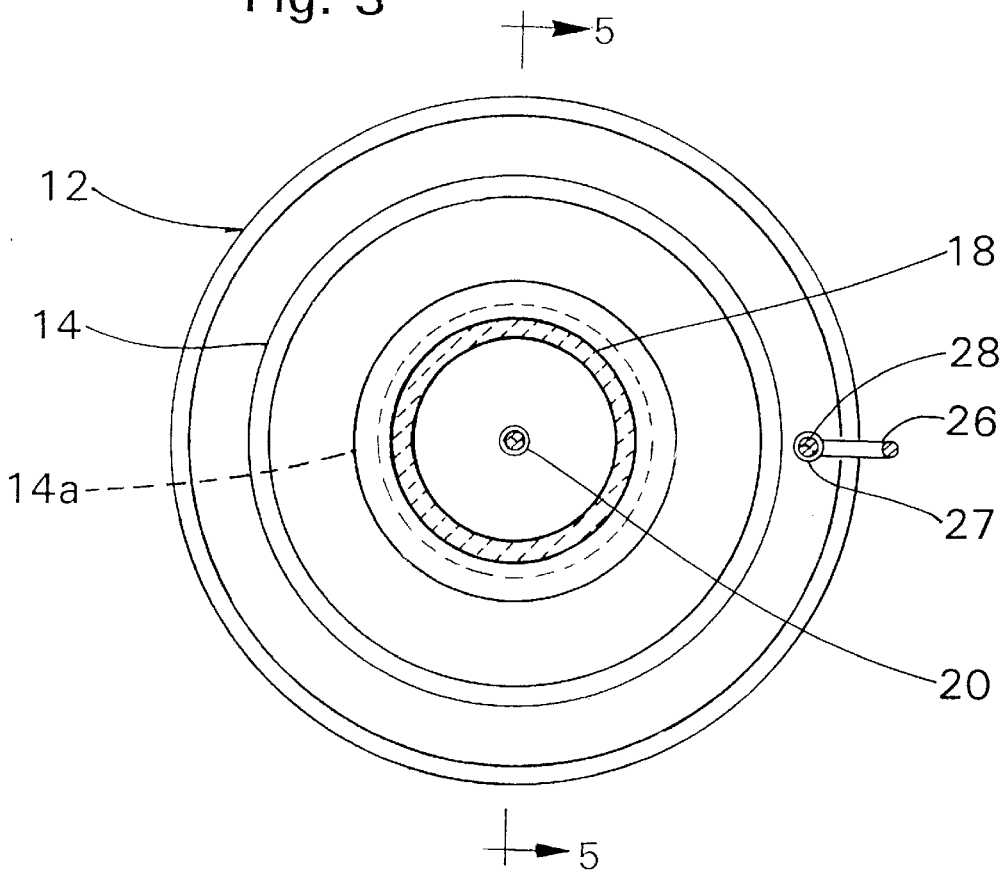
FIG. 3 is a sectional view of the yarn and thread dispenser of FIG. 2 taken along the line 3—3 therein.
Figure 4:
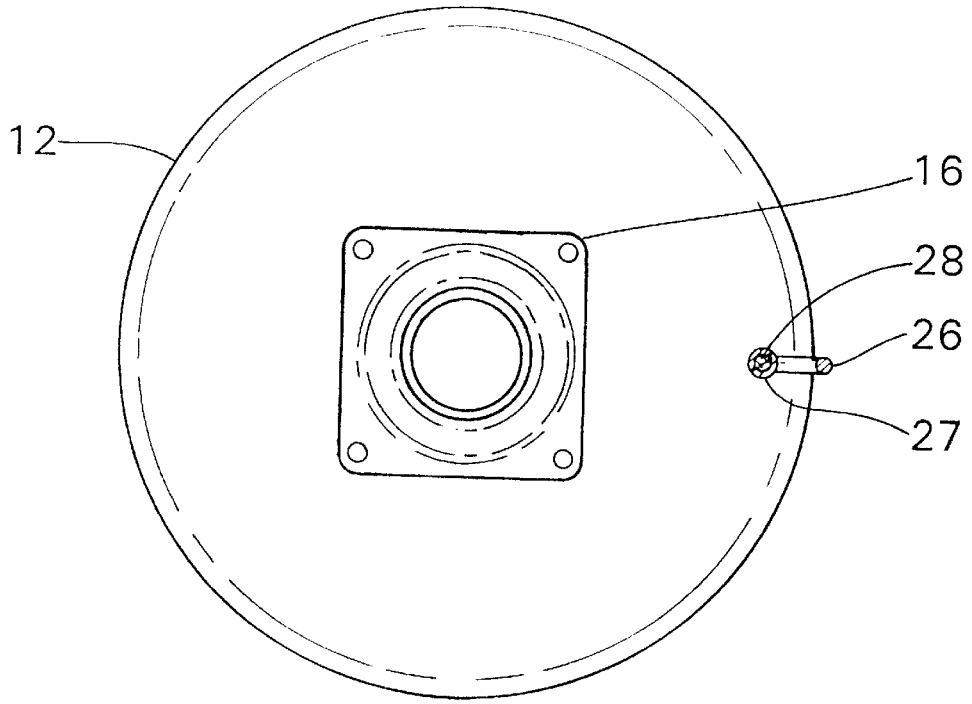
FIG. 4 is a sectional view of the yarn and thread dispenser of FIG. 2 taken along the line 4—4 therein.

The dispenser 10 is constructed having a base member 12 preferably made of a relatively dense, rigid material, such as wood or plastic, and formed having a circular configuration. Typical diameter of the base member 12 may vary between about 8–10 inches. Top and bottom surfaces of the base member 12 are substantially flat and parallel to each other and have a certain thickness therebetween, typically ¾14 1", sufficient to provide enough weight and resting mass to the base member for reducing sliding of the base member across the platform and stabilizing the dispenser 10 in operation thereon. The top surface of the base platform 12 may be finished with a radius or other rounded contour along its outer edge, as best viewed in FIGS. 2 and 5, provided the predominant portion of the top surface is maintained substantially flat and level with the bottom surface.

Referring further to FIGS. 2–5 in conjunction with FIG. 1, a support plate 14, circularly formed of a rigid material similar to that of the base member 12, is mounted concentrically upon the base member and rotatably connected thereto by a bearing coupler 16. In its circular configuration, the support plate 14 is formed having a smaller diameter relative to that of the base member 12 so that a substantially uniform outer edge of the top surface of the base member remains exposed around the support plate when the support plate is mounted over the base member. The support plate 14 is otherwise formed having substantially the same thickness and outer edge contour as the base member 14, with the top and bottom of the support plate being similarly flat and level except for a circular groove 14*a* and central opening formed upon the top surface of the base member. Best viewed in FIG. 5 and described in greater detail hereinbelow, the circular groove 14*a* is cut concentrically into the top surface of the support plate 14 to permit mounting engagement of a cone-shaped member 18 used in accordance with the present invention.

Bearing coupler 16 is a conventional coupling device commercially available for providing coaxial rotation between joined members. Typically having ball bearings 16*a* contained in a closed circular track between movable mating plate surfaces 16*b*, bearing coupler 16 is centrally positioned between the base member 12 and support plate 14 and secured therebetween by affixing the respective plate surfaces of the bearing coupler to the top surface of the base member and the bottom surface of support plate. In the present dispenser 10, the bearing coupler 16 thus provides coaxial rotation between the base member 12 and support plate 14 and permits the support plate to spin freely overtop the stationary base member when the dispenser is in use.

Cone-shaped member 18 is a rigid, hollow member removably mounted in an upright fashion normal to the support plate 14 so that it presents an expanding wedge-like form to spool 11. Preferably made from a hard, relatively non-deformable material, such as wood, plastic or fiberboard, the cone-shaped member 18 is set upon support plate 14 with its larger diameter and securely stationed upon the support plate engaged within the circular groove 14*a*. Engagement between the larger diameter end of the cone-shaped member 18 and the circular groove 14*a* of support plate 14 should be relatively tight with the end of the cone-shaped member being inserted snugly to the full depth of the groove completely therearound. Such an engagement between the cone-shaped member 18 and the support plate 14 assists in maintaining the proper erect position of the cone-shaped member while holding the spool 11 or other wound supply of threaded material and further in stabilizing the cone-shaped member and the engaged spool while spinning together during operation of the dispenser 10. The outer surface of the cone-shaped member 18 is preferably made coarse along the length thereof to increase its frictional resistance and assist in holding the spool firmly thereon during operation. The length of the cone-shaped member 18 and the resultant height thereof upon mounting to the support plate may vary in dimensions but typically will range between 6–8"with a resultant variation being reflected in the diameter of the narrow end of the cone-shaped member and the opening therethrough. An elongated rod 20, which may be fabricated of wood or plastic, is sized in diameter to fit snugly through the narrow end of the cone-shaped member 18 and is of sufficient length to extend completely therethrough. The bottom of the elongated rod 20 is fitted with a protective sleeve 21 and adapted for removable insertion into a central opening in the top surface of the support plate 14. The elongated rod 20 is thus mounted to the support plate 14 and disposed coaxially through the cone-shaped member 18 to provide support and stabilization for the cone member and the spool 11 intended to be held thereon during spinning operation of the dispenser 10. The top of the elongated rod 20 is fitted with a cap 22 that is intended to press upon and clamp the top of the spool 11, if necessary, and thereby confine its movement while being held on the cone member 18. Cap 22 may therefore be formed to move along the upper end of elongated rod 20 and thereby adjust to the length of the spool 11.

A guide assembly 24 is provided on the present dispenser for directing the threaded material 11*a* away from spool 11 as it spins, drawn by the user. The guide assembly 24 is mounted upon the base member 12 along the outer edge of its top surface and includes all elongated loop 26 pivotally connected to a rod member 28. The rod member 28, made typically of a length of wood or plastic material, is vertically mounted directly to the base member 12 in a substantially vertical position just outside the perimeter of the support plate 14. The elongated loop 26, fabricated of a relatively thick gauge of wire material having a smooth or coated surface, is formed having a curved or bowed configuration substantially through its length. At each end of the loop 26, a sleeve 27 is connected and the sleeves are aligned together to engage rod 28 so that the guide loop may pivot or swivel about the rod. This pivotal feature of the loop 26 and its elongated shape allows the yarn material to be drawn by the user at various angles to the dispenser 10 with reduced risk of tangling and jamming of the spool 11 as it unwinds. The bottom end of rod 28 is fitted for removable insertion into a circular opening made in the top surface of the base member 12 so that the rod and guide loop 26 stand substantially vertical and in parallel alignment with the elongated rod 20 and cone member 18. A protective cap 30 is attached to the upper end of rod 28 to cover its exposed surface and to confine the vertical travel of the guide loop 26 along the rod during operation of the dispenser 10.

In operation, therefore, the dispenser 10, described above and shown in FIGS. 1–5, serves to hold the spool 11 of yarn material 11*a* in proximity to a knitter or crocheter and allows the spool to be spun in place and thereby unwound as the yarn material is drawn by the user. The cone-shaped member 18 engages the central core of the spool 11 and holds the spool in a proper position for unwinding by means of a wedge-like interaction with the coarse outer surface of the cone member maintaining such position while the spool continues to spin thereon. As the yarn material 11*a* is drawn by the user and is routed through the elongated guide loop 26, the spool 11 spins freely together with the cone member 18 and support plate 14 by means of the rotational interaction provided by bearing coupler 16 and its engagement with the stationary base member 12. The spool 11 continues to spin and unwind as long as the user draws the yarn material 11*a* and the material is thus dispensed to the user.

Figure 6:
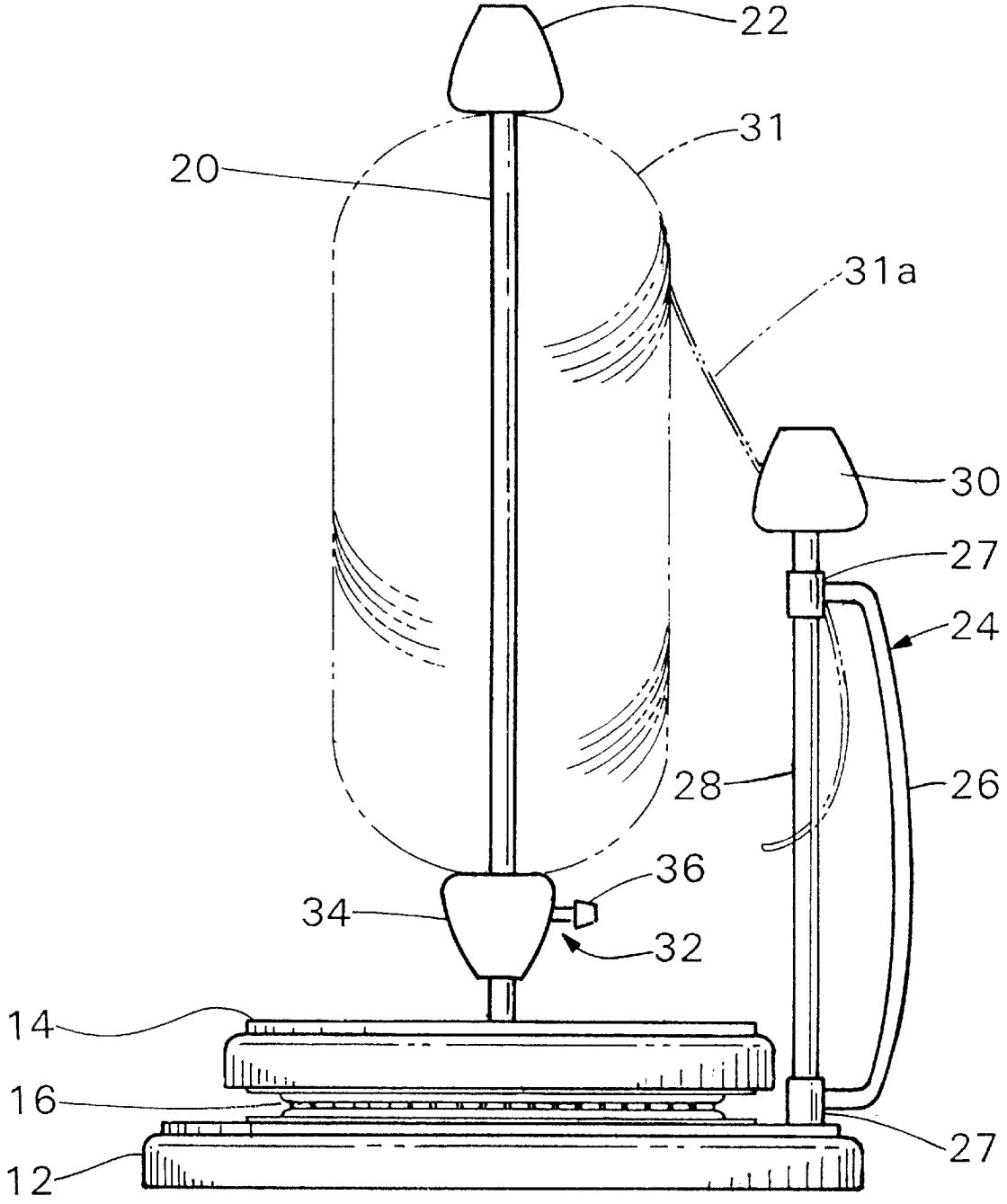
FIG. 6 is a side elevation view of a further embodiment of the present yarn and thread dispenser shown in operational engagement with a skein of stranded material.

An alternate embodiment of the present invention is shown in FIG. 6 for dispensing yarn or thread material from a skein 31 or similar wound length of yarn or thread having little or no rigid core structure as in the case of spool 11. This alternate embodiment of the inventive device is similar in all respects to the dispenser 10 described above with regard to FIGS. 1–5 except that the cone-shaped member 18 is removed from support plate 14 and an adjustable clamp assembly 32 is coaxially engaged upon the lower end of rod 20 to hold the skein 31 firmly in an erect attitude along the rod and permit the skein to be spun upon the support plate 14 in the same manner as spool 11 in FIG. 1. The clamp assembly 32 includes a clamp body 34 having a central opening longitudinally therethrough that is sized in diameter to allow the rod 20 to slide therethrough. A locking pin 36 adjustably set in a second opening in the clamp body 34 perpendicular to the axis of rod 20 is used to fix the position of the clamp body along the rod. The skein 31 is mounted for dispensing operation by inserting the bottom of the rod 20 through the skein with the clamp assembly 32 initially removed, then placing the clamp assembly onto the rod and locking it in position pressed between the clamp body 34 and cap 22 at the top of the rod. With the bottom of rod 20 inserted into the central opening of support plate 14, the yarn material 31*a* is routed through guide loop 26 and dispensed to the user as it is drawn from the spinning skein.

Therefore, it is apparent that the disclosed invention provides an improved device for dispensing yarn and other similar stranded material that may be wound in a variety of forms and configurations. The described invention more particularly provides a useful yarn dispenser for knitting or crocheting that effectively unwinds any of an assortment of spools and skeins of yarn material and feeds the unwinding material to the knitter or crocheter, as needed and drawn, in a smooth and untangled manner. The inventive device is further adjustable to hold and dispense the stranded material in a variety of wound forms commercially available for knitting and crocheting. Moreover, the disclosed yarn and thread dispenser is relatively inexpensive to manufacture, simple to set up and use, and easily maintained by the knitter or crocheter.

Obviously, other embodiments and modifications of the present invention will readily come to those of ordinary skill in the art having the benefit of the teachings presented in the foregoing description and drawings. It is therefore to be understood that various changes in the details, materials, steps and arrangement of parts, which have been described and illustrated to explain the nature of the invention, may be made by those skilled in the art within the principle and scope of the invention as expressed in the appended claims.

What is claimed:

1. A device for dispensing a wound supply of yarn material, comprising:

a base member adapted to rest on a substantially horizontal surface;

a support plate rotatably coupled to said base member so that said plate spins relative to said base member; and conical means mounted in an upright position coaxially upon said support plate and adapted to engage the wound supply so that the supply is spun in place upon drawing yarn material therefrom; and guide means mounted to said base member and assembled having an elongated loop positioned substantially parallel to said conical means and pivotally disposed for directing the yarn material drawn from the wound supply.

2. A dispensing device according to claim 1, wherein said guide means further comprises:

a rod member mounted upon said base member in a vertical position alongside said support plate; and said elongated loop is rotatably coupled to said rod member to allow the yarn material to be drawn from various angles without tangling.

3. A dispensing device according to claim 1, wherein said conical means further comprises:

a cone-shaped member coaxially mounted to said support plate in an erect position having the larger end of said cone-shaped member facing downward upon said support plate and secured thereto.

4. A dispensing device according to claim 3 wherein said conical means further comprises:

an elongated rod adapted to be connected to said support plate substantially perpendicular thereto and extended coaxially through said cone-shaped member.

5. A dispensing device according to claim 3, wherein said cone-shaped member is formed having a coarse outer surface along the length thereof.

6. A dispensing device according to claim 5 wherein said support plate is provided with a circular groove formed upon the upper surface thereof to engage the downwardly facing end of said cone-shaped member.

7. A device for dispensing a skein of yarn material, comprising:

a base member adapted to rest on a substantially horizontal surface;

a support plate rotatably coupled to said base member so that said plate spins relative to said base member;

an elongated rod adapted to be mounted perpendicularly and coaxially to said support plate for holding the skein in a substantially vertical position thereupon; and clamp means coupled to said elongated rod along the length thereof for securing the skein upon said elongated rod so that the skein rotates together with said rod and spins upon said support plate, said clamp means including an adjustable clamp member coaxially engaged to move along said elongated rod and thereby compress the skein upon said rod so that the position of the skein is maintained while spinning.

8. A dispensing device according to claim 7 further comprising:

guide means mounted to said base member and assembled having an elongated loop pivotally disposed for directing the yarn material drawn from the wound supply.

9. A dispensing device according to claim 8, wherein said guide means further comprises:

a rod member mounted upon said base member in a vertical position alongside said support plate; and said elongated loop is rotatably coupled to said rod member to allow the yarn material to be drawn from various angles without tangling.

* * * * *